United States Patent [19]

Driscoll

[11] 4,330,889

[45] May 25, 1982

[54] SLEEPING AND MEDITATION BAG

[76] Inventor: John Driscoll, 358-Seventh Ave., Brooklyn, N.Y. 11215

[21] Appl. No.: 113,535

[22] Filed: Jan. 21, 1980

[51] Int. Cl.[3] ..... A47G 9/00

[52] U.S. Cl. ..... 2/69.5; 5/413

[58] Field of Search ..... 2/69, 69.5; 5/413, 414, 5/415, 416; 4/536, 537

[56] References Cited

U.S. PATENT DOCUMENTS

| | | | |
|---|---|---|---|
| 2,064,458 | 12/1936 | Bulpit et al. | 2/69.5 |
| 2,931,043 | 4/1960 | Achner | 2/69.5 |
| 3,443,066 | 5/1969 | Weibel | 2/69.5 |
| 3,639,931 | 2/1972 | McGuire | 2/69.5 |
| 4,125,910 | 11/1978 | Nicholai | 2/69.5 |

*Primary Examiner*—Henry Jaudon

*Attorney, Agent, or Firm*—Marvin Feldman; Stephen E. Feldman

[57] ABSTRACT

A sleeping and meditation bag has a first position to accomodate the user in a sitting, cross-legged posture and a second position to accomodate the user in a reclining posture. The bag comprises a first portion to accomodate the shoulders and extended elbows of the user in the first position. A second portion of the bag accomodates the trunk of the user and is joined to the first portion. This second portion has a width substantially coincident to the greatest width of the first portion. A third portion has one end adjacent the second portion and is substantially the same width as the second portion to accomodate the extended knees of the user in the first position. The third portion is tapered towards an end surface of the bag to accomodate the feet of the user in the second position.

9 Claims, 6 Drawing Figures

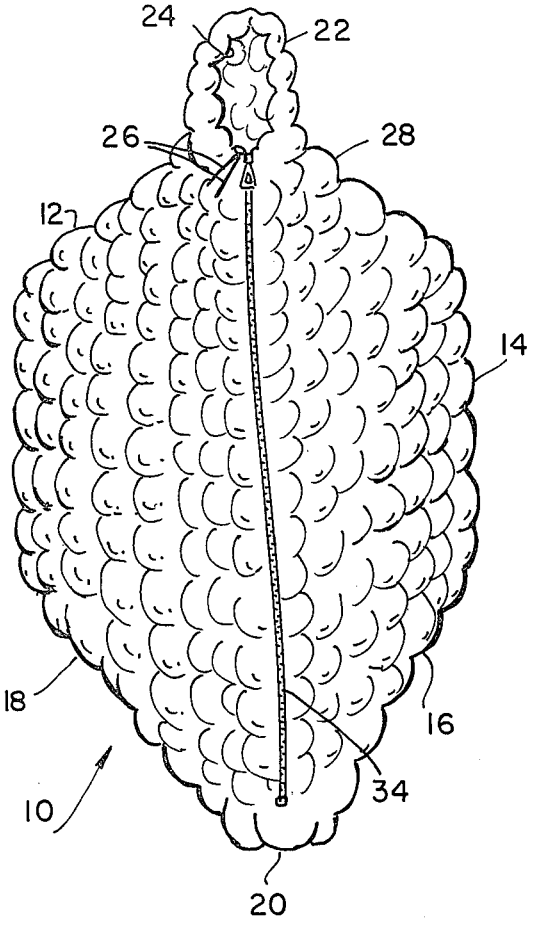
FIG. 1
FIG. 2
PRIOR ART
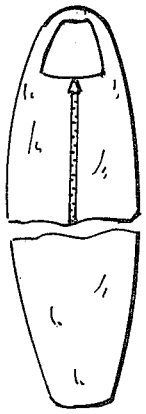
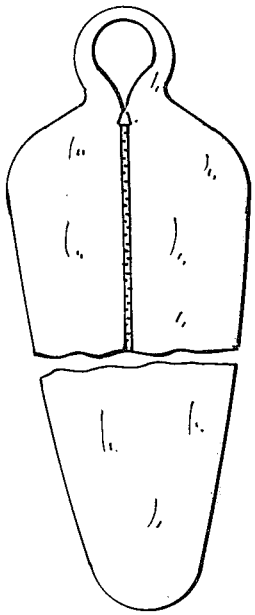
PRIOR ART
FIG. 3

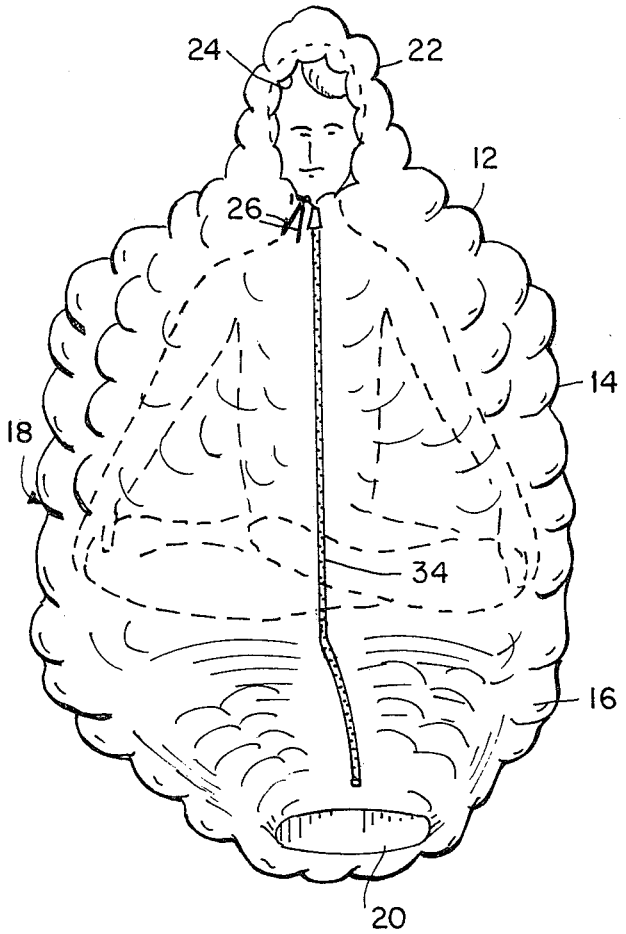
FIG. 4
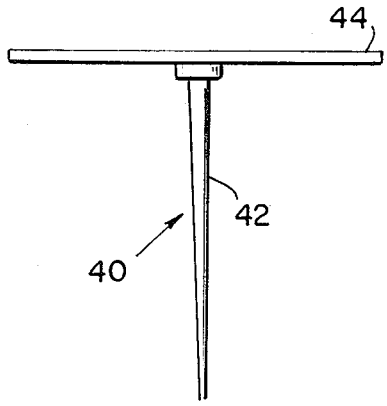
FIG. 5
FIG. 6
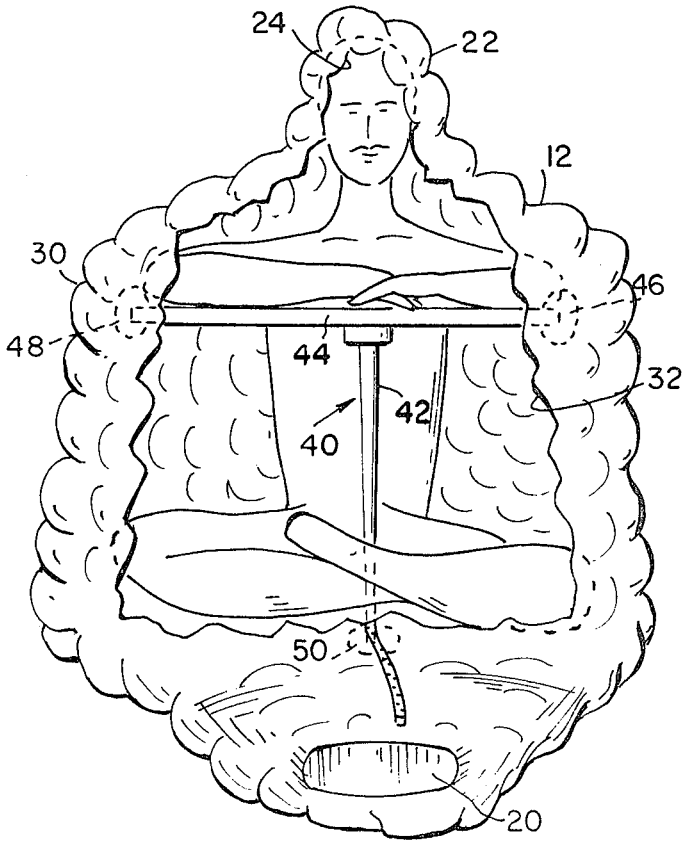

SLEEPING AND MEDITATION BAG

BACKGROUND OF THE INVENTION

While the invention is subject to a wide range of applications, it is especially suited for use as a sleeping and meditation bag and will be particularly described in that connection.

The present invention relates to a bag which can be used both in a sitting position during activities such as meditation, and in a reclining position for activities such as sleeping. In the past, there have been a number of patents which were drawn to sleeping bag constructions, however they did not enable the user to sit in a meditation pose.

For example, U.S. Pat. No. 3,787,906 to Hunt discloses for example, a sleeping bag having the overlapping layers to be disposed in generally side-by-side relationship to enable the bag to be extended to provide a covering useable by more than one person. This sleeping bag differs from the present invention in that it is generally used by a single individual and at the time the bag is generally constructed in accordance with the size of a single individual. When the bag is opened into the emergency configuration, and it is suitable for two persons, the foot section remains open.

U.S. Pat. No. 3,443,066 to Weibel discloses a heated outdoor garnment which is suitable for one or more people. The garnment includes an electric heater therein and is not tapered to fit a single individual.

It is an object of the present invention to provide a sleeping and meditation bag to accomodate a single user in a sitting, cross-legged posture, and in a reclining posture.

It is a further object of the present invention to provide a sleeping and meditation bag which is relatively inexpensive to manufacture.

It is a further object of the present invention to provide a sleeping and meditation bag which is relatively compact.

SUMMARY OF THE INVENTION

Accordingly, there has been provided a sleeping and meditation bag having a first position to accomodate the user in a sitting, cross-legged posture and a second position to accomodate the user in a reclining posture. The bag comprises a first portion to accomodate the shoulders and extended elbows of the user in the first position. A second portion of the bag accomodates the trunk of the user and is joined to the first portion. This second portion has a width substantially coincident to the greatest width of the first portion. A third portion has one end adjacent the second portion and is substantially the same width as the second portion to accomodate the extended knees of the user in the first position. The third portion is tapered towards an end surface of the bag to accomodate the feet of the user in the second position.

For a better understanding of the present invention, together with other and further objects thereof, reference is had to the following description, taken in connection with the accompanying drawings, while its scope will be pointed out in the appended claims.

BRIEF DESCRIPTION OF THE DRAWINGS

FIG. 1 is a top view of a sleeping and meditation bag of the present invention;

FIG. 2 is a top view of a sleeping bag known in the prior art;

FIG. 3 is a top view of a sleeping bag known in the prior art;

FIG. 4 is a front view of the sleeping and meditation bag used by a person sitting in a cross-legged posture;

FIG. 5 is a side view of a meditation support; and

FIG. 6 is a front view of a sleeping and meditation bag being used by a person sitting in a cross-legged posture and using a meditation support stick.

DESCRIPTION OF THE PREFERRED EMBODIMENT

A sleeping and meditation bag 10 is disclosed for use in a first position to accomodate the user in a sitting, cross-legged posture and in a second position to accomodate the user in a reclining posture. A first portion 12 accomodates the shoulders and extended elbows of the user in the first position. A second portion 14 accomodates a trunk of the user and is joined to the first portion 12. The second portion has a width which is substantially coincident with the greatest width of the first portion. A third portion 16 has an end 18 adjacent the second portion 14 and is substantially the same width as the second portion to accomodate the extended knees of the user when the bag is in the first position. Also, the third portion is tapered towards and adjacent to an end surface 20 of the bag to enclose the feet of a user in the second position.

A sleeping and meditation bag as illustrated in FIG. 1 is disclosed and can be used in at least a first and second position. The first position is shown in FIG. 4, where the user may sit in a cross-legged posture and be enclosed within the bag. The second position is shown in FIG. 1 where the bag is laid out flat and the user may be in a reclining posture.

As seen in FIG. 1, the bag 10 includes a fourth portion 22 affixed to the first portion 12 to accomodate the head of the user. This portion 22 has an opening 24 to expose the face of the user. A draw string 26 extends around the opening 24 to enable the user to increase or decrease the size of the opening as desired.

The first portion 12 is attached at the narrow end 28 to the fourth portion 22. From the narrow end 28, the first portion tapers outward to its greatest width which is able to accomodate the shoulders and the extended elbows of the user as will be further explained. The second portion 14 of the bag extends from the greatest width of the first portion. This second portion maintains substantially the same width for its entire length. This length is able to accomodate the trunk of the user as illustrated in FIG. 4.

The third portion 16 has an end 18 which is adjacent the second portion and is substantially the same width as the second portion to accomodate the extended knees of the user in the first position. The third portion is tapered down towards an end surface 20 of the bag to enclose the feet of a user in the second position. The end surface 20 is preferably large enough to only accomodate the feet of the user and in general, the third portion is tapered to use the minimum amount of material and space required in order that the bag will more snugly receive the user in the second reclining posture. It is generally understood that the entire bag and in particular the first, third and fourth portions are constructed in a manner to limit the space and material of the bag so that it will conform to a single user as much as possible.

This leads to a bag which is both warm, light-weight, and relatively easy to roll into a compact shape.

It should be noted that the bag of the present invention has a considerably different shape from the sleeping bags of the prior art. For example, neither of the typical prior art bags in FIGS. 2 and 3 have both a wide portion for sitting and a narrow portion to prevent heat loss.

The general construction of the bag provides a substantially constant width and a quilted structure formed from an inner and outer fabric 30 and 32 with a filling material in between. The inner and outer fabric may be of any desired material, such as for example, nylon. The filling material is preferrably able to compress and provide a lofting to maintain a separation between the inner and outer fabric. This fill material may include artificial fibers or natural fibers, such as for example, goose down. It is also within the scope of the present invention to form the bag out of a single layer of material such as for example, wool or flannel.

A closure 34 such as for example, a zipper extends from the opening 44 to the lower end of the third portion of the bag. This zipper allows the user to easily enter and close the bag as required. Since it extends the length of the bag, it provides an additional function in allowing the bag to be open during use in the event that additional air is desired.

A meditation support stick 40 is illustrated in FIG. 5 and includes a T-shaped member having a leg 42 topped by a cross member 44. The meditation support stick is used by a cross member 44. The meditation support stick is used by a person meditating as will be further explained.

Pads 46, 48 and 50 are provided on the inner fabric 32 in a position to contact the end of the support stick 40 when it is in use and thereby prevent any tearing of the inner fabric. These pads may be made of any desired material such, as for example, canvas, leather, or some synthetic such as plastic or nylon.

To more fully understand the advantages of the present invention, a description of its use in the first and second positions is provided.

An individual may wish to use the sleeping and meditation bag 10 in a first position as shown in FIG. 4. In this case, the bag may be unzipped and the individual can sit in the bag in a cross-legged position. The second portion of the bag is long enough to accomodate the trunk of the user and is of a width to accomodate the extended knees of the user. It should be noted that the third portion of the bag is substantially the same width as the second portion to provide for the comfort of the user. In the first position, the legs are not necessarily extended into the third portion 16 however, if desired they may be extended into that part of the bag. Since the third portion is of a width which can accomodate the crossed-legs of the user, the legs can be easily moved from the crossed to the extended position. The first portion of the bag may rest on the shoulders of the user. Alternatively, if the fourth portion is supported by the user's head, the first portion may be raised off of the shoulders.

In some instances the user may wish to use a meditation support stick 40 as shown in FIG. 6. This is advantageous in that the user may rest his arms on the cross member 44 to help overcome his posture. The first portion 12 of the bag is wide enough to accomodate the length of the cross member as weli as the extended elbows of the user in this first position. Note that the pads 46 through 50 are located on the inner fabric to prevent any tearing of the bag.

The bag may be used in a second position where it is just layed out flat as shown in FIG. 1. This enables the user to lie in a reclining posture for sleeping. In this case, the user simply unzips the bag, enters and zips it back up. The excess material on either side of the bag lies against itself and prevents heat loss from the bag.

The bag may be rolled up or stuffed in a stuff sack and be easily transported as required.

It can be readily seen by one skilled in the art that there has been provided a sleeping and meditation bag which can be used in two positions, is relatively inexpensive to produce and can easily be rolled into a compact form.

While there has been described what is at present considered to be the preferred embodiments of the invention, it will be obvious to those skilled in the art that various changes and modifications may be made therein without departing from the invention, and it is, therefore, aimed in the appended claims to cover all such changes and modifications as fall within the true spirit and scope of the invention.

I claim:

1. A sleeping and meditation bag for use in sleeping and meditation having a first position to accomodate the user in a sitting, cross-legged posture and in a second position to accomodate the user in a reclining posture comprising:

a first portion to accomodate the shoulders and extended elbows of the user and to accomodate a meditation support stick in the first position;

a second portion to accomodate the trunk of the user being joined to said first portion and being substantially coincident with the greatest width of the first portion, and a third portion having one end adjacent said second portion and being substantially the same width as said second portion to accomodate the extended knees of the user in the first position and being tapered toward and adjoined to an end surface of the bag to enclose the feet of a user in the second position and further comprising pad means inside the bag to accomodate said user or stick.

2. The sleeping and meditation bag as defined in claim 1 further characterized in that a fourth portion is afixed to said first portion to accomodate the head of the user and having an opening to expose the face of the user.

3. The sleeping bag as defined in claim 2 further characterized in that said fourth portion includes a draw string encircling the opening to close said opening.

4. The sleeping and meditation bag as defined in claim 1 further characterized in that a zipper extends from the opening in said fourth portion to the third portion to open the bag.

5. The sleeping and meditation bag as defined in claim 1 further characterized in that said first, second, third and fourth portions are joined together to form a unitary structure.

6. The sleeping and meditation bag as defined in claim 1 further characterized in that said bag has an inner and outer fabric with a filling material in between to maintain heat inside the bag.

7. The sleeping and meditation bag as defined in claim 1 further comprising a meditation support stick accomodated in the first portion when the user is in the first position.

8. The sleeping and meditation bag as defined in claim 7 further characterized in that said pad means being in said first portion to prevent wear by said meditation support stick.

9. The sleeping and meditation bag as defined in claim 8 further characterized in that said bag may be rolled into a compact shape.

* * * * *